US005704165A

United States Patent [19]

Slocomb et al.

[11] Patent Number: 5,704,165

[45] Date of Patent: Jan. 6, 1998

[54] PIVOTABLE WINDOW SASH ASSEMBLY

[75] Inventors: Colin Slocomb, Wilmington, Del.; Scott E. Beard, Lewisburg, W. Va.

[73] Assignee: CSB Enterprises, Inc., Wilmington, Del.

[21] Appl. No.: 684,082

[22] Filed: Jul. 19, 1996

[51] Int. Cl.[6] ..... E05D 15/22

[52] U.S. Cl. ..... 49/181; 49/176

[58] Field of Search ..... 49/161, 176, 181, 49/182, 430, 446

[56] References Cited

U.S. PATENT DOCUMENTS

| | | | |
|---|---|---|---|
| 4,581,850 | 4/1986 | Simpson | 49/181 |
| 4,683,676 | 8/1987 | Sterner | 49/176 X |
| 4,718,194 | 1/1988 | FitzGibbon et al. | 49/181 |
| 4,926,524 | 5/1990 | Owens | 49/176 X |
| 4,930,254 | 6/1990 | Valentin . | |
| 5,069,001 | 12/1991 | Makarowski . | |
| 5,237,775 | 8/1993 | Hardy . | |
| 5,243,783 | 9/1993 | Schmidt et al. | 49/176 X |

*Primary Examiner*—Jerry Redman
*Attorney, Agent, or Firm*—Connolly & Hutz

[57] ABSTRACT

A pivotable window sash assembly includes a pivot bar which engages a balance shoe for holding the sash to a master frame. The shoe has a recess in which a locking member is rotatably mounted. The locking member includes an exposed keyway which is selectively aligned with at least one slot in the shoe located at the recess. The pivot bar has an arm which functions as a key for fitting in the keyway and has at least one projection extending outwardly from the arm for fitting in each slot when the slot and keyway are aligned.

20 Claims, 2 Drawing Sheets

PIVOTABLE WINDOW SASH ASSEMBLY

BACKGROUND OF INVENTION

Various types of window assemblies exist including a pivotable window sash assembly which includes a tilt window sash mounted to a channeled window frame. In use, the window sash would move up and down and would also be capable of pivoting outwardly with respect to the window frame for access, for example, in cleaning the window. A conventional mechanism for accomplishing these movements is to include a balance shoe which is mounted for slidable movement in a channel in the window frame. A pivot bar is secured to the window sash and is engaged with the balance shoe. In this manner the balance shoe moves in the channel which acts as a track during the up and down movement of the window sash. In one form of balance shoe a freely mounted sleeve is included in the balance shoe with a slot in the sleeve engaged by an arm on the pivot bar. As a result, it is possible to rotate the window sash because of the pivotal connection effected by the sleeve being able to freely pivot within its balance shoe.

U.S. Pat. Nos. 4,930,254, 5,069,001 and 5,237,775 reflect various prior art approaches for mounting a pivot bar to a balance shoe and various details of pivotable window sash assemblies.

SUMMARY OF INVENTION

An object of this invention is to provide a pivotable window bar assembly which includes a pivot bar for holding the sash to a master frame.

A further object of this invention is to provide such a pivot bar which may be effectively mounted to a balance shoe to keep the sash tight and to keep the master frame plumb.

In accordance with this invention the balance shoe which is slidably mounted in the channel of a window frame includes a recess in which is rotatably mounted a locking member. The locking member has an exposed keyway. At least one slot is provided at the recess for selective alignment with the keyway. The pivot bar has an arm which functions as a key for fitting in the keyway. The arm also includes a projection extending outwardly from the arm to fit in the slot only when the slot and keyway are aligned.

In a preferred practice of this invention two slots are provided at the recess and two projections, each in the form of a pin, is provided on the arm. The keyway further includes an extension which fits in a channel form in the arm.

THE DRAWINGS

DETAILED DESCRIPTION

Figure 1:
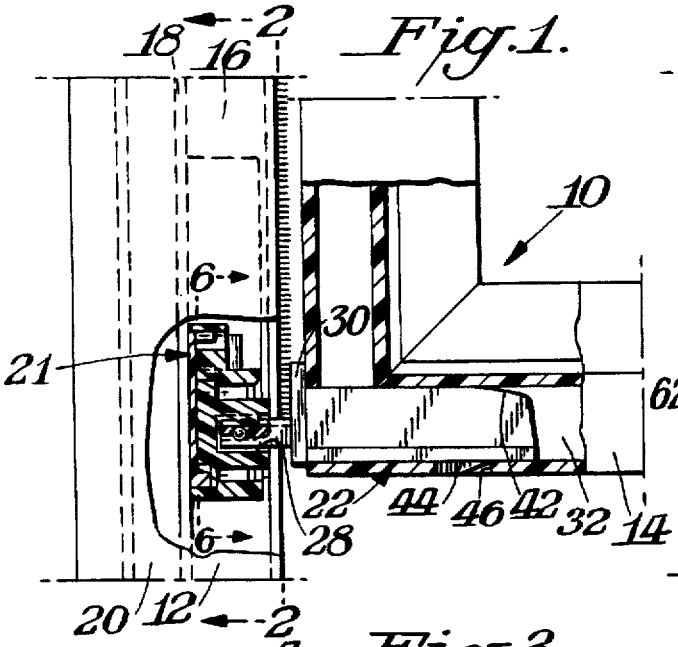
FIG. 1 is a fragmental front elevational view showing a portion of a pivotable window sash assembly in accordance with this invention.
Figure 2:
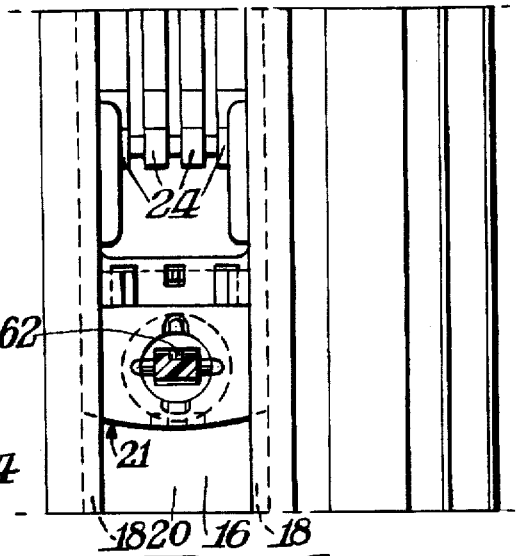
FIG. 2 is a cross-sectional view taken through FIG. 1 along the line 2—2.
Figure 5:
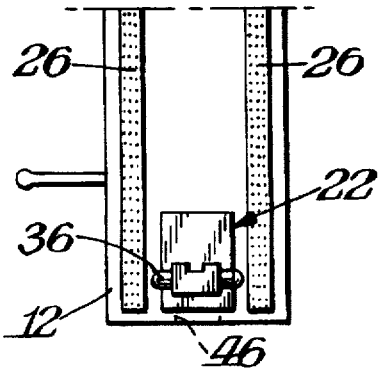
FIG. 5 is a side elevational view showing the pivot bar mounted in the balance shoe.
Figure 6:
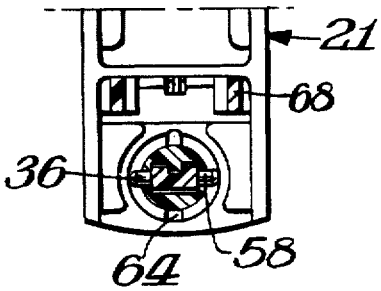
FIG. 6 is a cross-sectional view taken through FIG. 1 along the line 6—6.

FIG. 1 illustrates a portion of a pivotable window sash assembly in accordance with this invention. Most of the components of the assembly 10 may be of known construction wherein, for example, a main frame 12 is provided made of extruded PVC. Frame 12 is, for example, a master frame. The window sash 14 may also be an extruded PVC lift rail. Main frame 12 includes a plurality of channels. One of the channels is channel 16 formed by a pair of flanges 18 which extend over and are parallel to the base wall 20. This channel serves as a track for a modification of a known balance shoe 21. Balance shoe 21 would slide in track 16 under the urging or against the force of, for example, springs 24. Felt strips 26 are mounted to a wall of window sash 12. See FIG. 5

Figure 8:
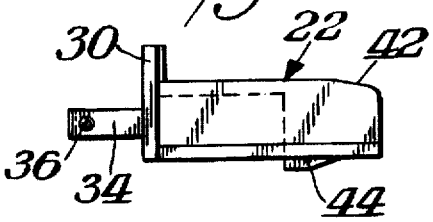
FIG. 8 is a side elevational view of the pivot bar shown in FIGS. 1–7.
Figure 9:
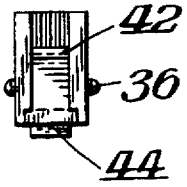
FIG. 9 is an end elevational view of the pivot bar shown in FIG. 8.
Figure 11:
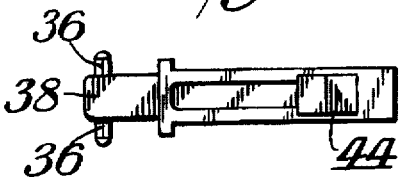
FIG. 11 is a bottom plan view of the pivot bar shown in FIGS. 8–10.

Lift rail window sash 14 contains a modification of a known pivot bar 22 which is inserted into the hollow window sash 14 into opening 32. Pivot bar 22 includes an extension 30 peripherally along three sides thereof to act as a stop member and prevent pivot bar 22 from being completely inserted into the hollow opening 32 of sash 14. Extension 30 is clearly shown in FIGS. 8 and 1011.

Exemplary construction of known pivotable window sash assemblies are found in U.S. Pat. Nos. 4,930,254, 5,069,001 and 5,237,775, the details of which are incorporated herein by reference thereto.

Figure 10:
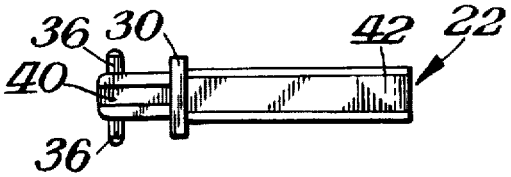
FIG. 10 is a top plan view of the pivot bar shown in FIGS. 8–9.
Figure 7:
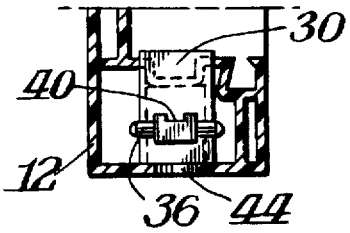
FIG. 7 is a left end elevational view of a portion of the assembly shown in FIGS. 1–6.

As shown in FIGS. 8–11 pivot bar 22 includes a pair of projections 36,36 in the form of pins which extend inwardly from the outer edge 38 of arm 34. Arm 34 has a channel 40 in its upper surface as shown in FIG. 10 and as also shown in FIG. 7. The opposite end of pivot bar 22 has a downwardly sloping surface 42. The bottom wall of pivot bar 22 includes a locking projection 44 which extends into an opening 46 as shown in FIG. 1 and as described in greater detail in co-pending application Ser. No. 08/641,433 filed May 1, 1996, in the names of Colin L. Slocomb and Edward J. Subliskey, the details of which are incorporated herein by reference thereto.

Figure 12:
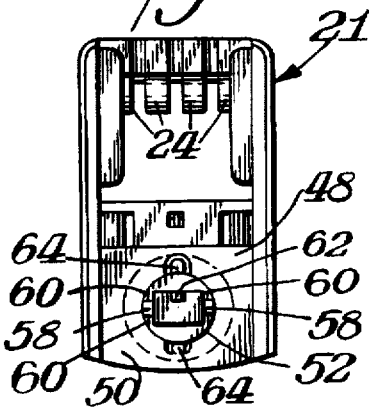
FIG. 12 is a front elevational view of the balance shoe shown in FIGS. 1–7 when the keyway and slots are out of alignment.
Figure 14:
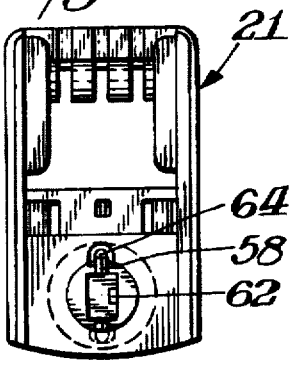
FIG. 14 is a front elevational view of the balance shoe shown in FIGS. 12–13 when the keyway and slots are in alignment.

FIGS. 12–15 show the details of the balance shoe 21. As shown therein balance shoe 21 includes a U-shaped housing 48 having a wall 50 disposed toward pivot bar 22. Wall 50 includes an opening or recess 52 in which is mounted a locking member 54. Locking member 54 is in the form of a disk body having a boss 56 which extends through opening 52 so that the locking member or disk 54 may freely rotate in the housing 48. Boss 56 includes a recess forming a keyway 58 having generally the same shape but slightly larger than pivot bar arm 34. Keyway 58 includes pairs of end shoulders 60 with a single projection 62 formed along one side of and extending into the keyway. A pair of slots 64 are formed in housing wall 50 aligned with each other and communicate with the recess 52. Thus, the keyway 58 may be selectively aligned with the slots 64,64 as shown in FIG. 14 or selectively rotated out of alignment with the slots as shown in FIG. 12.

Figure 3:
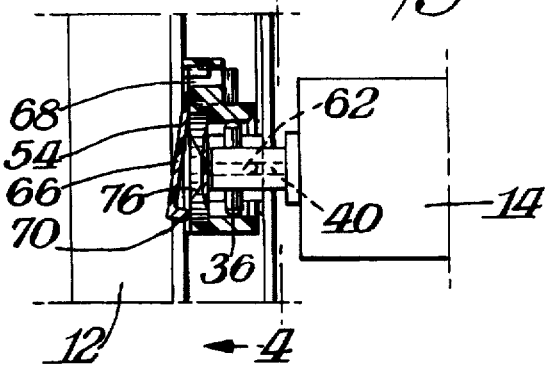
FIG. 3 is a view similar to FIG. 1 showing the position of the window sash assembly structure rotated 90°.

A plate 66 is mounted in the open end of U-shaped housing 48 opposite wall 50. Plate 66 is shown in FIG. 3 to be fixedly mounted or anchored at its end 68. The opposite end 70 of plate 66, however, may move outwardly from housing 48 under the influence of rotating disk 54 as also shown in FIG. 3. End 70 includes a pair of peripheral flanges 72 along each side thereof which fit within the U-shaped housing 48. See FIGS. 13 and 15. A tapered tongue 74 extends from the central portion of plate 66. Tongue 74 may be selectively engaged in a correspondingly shaped notch 76 in locking member or disk 54.

Figure 13:
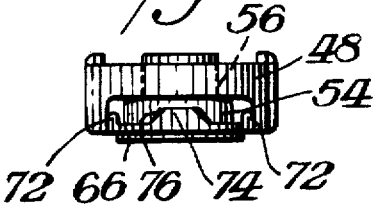
FIG. 13 is a bottom plan view of the balance shoe shown in FIG. 12.
Figure 15:
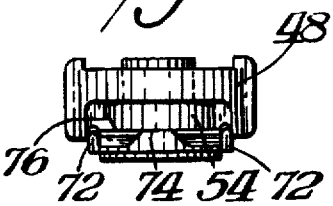
FIG. 15 is a bottom plan view of the balance shoe shown in FIG. 14.

FIGS. 12–13 show the relative position of plate 66 and disk 54 when the keyway 58 is completely out of alignment with slots 64. As shown therein, tongue 72 is engaged in notch 74 to maintain the disk 54 in its non-aligned position. Because of the resilient nature of plate 66 tongue 70 is urged to remain in engagement in notch 74 thus helping to hold the components against any further movement unless a positive force is applied. This condition shown in FIGS. 12 and 13 represents the sash 14 being moved to its closed position for closing the window and thus helping to maintain the window closed.

Figure 4:
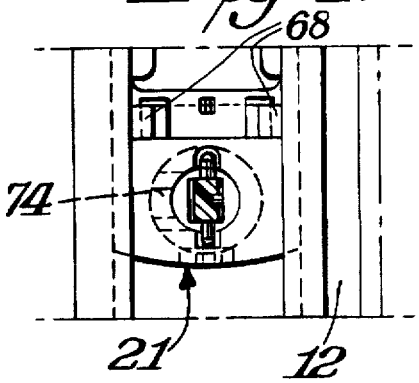
FIG. 4 is a cross-sectional view taken through FIG. 3 along the line 4—4.

In order to assemble the various components pivot bar 22 is installed into opening 32 of sash 14 at, for example, the manufacturing site. Extension 30 limits the degree to which the pivot bar can be inserted into the sash 14. If desired, the utilization of the locking projection 44 may help securely mount the pivot bar to the sash, although such locking projection is not necessary for the practice of the invention. Balance shoe 21 is also installed in main frame 12 during initial assembly. Sash 14 is positioned so that the pins 36,36 extending from arm 34 of pivot bar 22 are aligned with slots 64,64 and boss 56 is rotated to align keyway 58 with slots 64,64. Pivot bar 22 is then pushed toward balance shoe 21 to engage arm 34 into the balance shoe 21 and thus lock the pivot bar 22 to the balance shoe 21. This is the condition of balance shoe 21 shown in FIGS. 14–15 as well as, for example, FIGS. 3–4. This would also represent sash 14 being in a window-open condition with respect to main frame 12.

After the window assembly has been mounted in place pivot bar 22 remains engaged with balance shoe 21 thereby permitting sash 14 to be rotated or pivoted from a completely closed condition where the locking components are shown in FIGS. 12 and 13 with tongue 74 engaged in notch 76 to an open position such as shown in FIGS. 3–4 and 14–15. During the rotation of sash 14 from the completely closed position the inclined walls of notch 76 function as a cam with respect to the inclined walls of tongue 74 to overcome the resilient engagement of the tongue in the notch and thus permit the boss 56 to be rotated to a condition where the tongue 74 rests on the upper edge of the boss as shown in FIG. 14 rather than in the notch. During this open condition of sash 14, pins 36,36 are rotated away from slots 64,64 and are disposed under portions of wall 50 to effectively maintain engagement between pivot bar 22 and balance shoe 21.

It is to be understood that the above description and the drawings relate to the preferred practice of the invention. The invention, however, may be practiced in other manners. For example, instead of having pins 36,36 integral with arm 34, arm 34 could have a hole completely therethrough with a shaft or other structural member in the hole and extending outwardly of the hole to perform the function of the pins.

In addition, although in the preferred practice a pair of aligned slots are provided for selective alignment with the keyway, other arrangements may be used. Thus the invention may be practiced with only one slot or with more complicated aligning structure, such as a keyway having an additional diverging recess for alignment for yet still another slot. Similarly, while the invention is preferably practiced by utilizing pins for engagement in the slots, other types of projections or structure may be used. The intent is to provide complementary projections which fit in complementary openings with respect to the pivot bar and balance shoe.

What is claimed is:

1. A pivotable window sash assembly in combination with a tilt window sash and a channeled window frame mounting said tilt window sash to said channeled window frame, said assembly, said window frame having an elongated channel functioning as a track, a balance shoe slidably mounted in said channel for movement therein, a pivot bar mounted to said window sash, said pivot bar being pivotally engaged with said balance shoe to connect said window sash with said balance shoe for joint movement of said window sash and said balance shoe and for selective pivotal movement of said window sash with respect to said balance shoe and said window frame, said balance shoe having a recess, a locking member rotatably mounted in said recess, said locking member having a keyway on surface of said balance shoe disposed toward said pivot bar, at least one slot in said balance shoe located at said recess for being selectively aligned with said keyway, said pivot bar having a body portion which fits in said window sash, an arm extending outwardly from said body portion toward said balance shoe, said arm comprising a key shaped to fit in said keyway, and said arm having a projection extending outwardly therefrom to fit in said slot only when said slot and said keyway are aligned.

2. The assembly of claim 1 wherein said arm includes a channel and said keyway having an extension positioned to fit in said channel to permit entry of said key into said keyway only when said extension fits in said key channel.

3. The assembly of claim 2 wherein there are two of said slots mounted diametrically opposite each other, and two of said projections being mounted to said key on opposite sides of said key for engagement in said slots.

4. The assembly of claim 3 wherein said projections are pins.

5. The assembly of claim 4 wherein said locking member is a disk mounted in said balance shoe, said disk including a boss extending outwardly from said disk and disposed in said recess, and said keyway being in said boss.

6. The assembly of claim 5 wherein said balance shoe includes a housing portion having a wall disposed toward said pivot bar, said recess being an opening extending completely through said wall, and said boss extending through said opening.

7. The assembly of claim 6 wherein said housing is of U-shape with an open side opposite said wall, a plate mounted to said open side by a connection at a portion of said plate remote from said disk, said plate being anchored at said connection and having a resiliantly mounted free end opposite said disk, said free end being movable toward and away from said disk, said free end having a tongue extending toward said disk, and a notch in said boss for selective engagement by said tongue to restrain said disk from rotational movement.

8. The assembly of claim 7 wherein said tongue has converging sides which are complementary to converging sides of said notch to function as cam structure.

9. The assembly of claim 5 wherein said tongue is mounted in said notch when said slots are out of alignment with said keyway and when said sash is in its closed position with respect to said frame.

10. The assembly of claim 2 wherein said balance shoe includes a housing portion having a wall disposed toward said pivot bar, said recess being an opening extending completely through said wall, and said boss extending through said opening.

11. The assembly of claim 10 wherein said housing is of U-shape with an open side opposite said wall, a plate mounted to said open side by a connection at a portion of said plate remote from said disk, said plate being anchored at said connection and having a resiliently mounted free end opposite said disk, said free end being movable toward and away from said disk, said free end having a tongue extending toward said disk, and a notch in said boss for selective engagement by said tongue to restrain said disk from rotational movement.

12. The assembly of claim 11 wherein said tongue is mounted in said notch when said slots are out of alignment with said keyway and when said sash is in its closed position with respect to said frame.

13. A pivot bar used in a pivotable window sash assembly for engagement with a balance shoe mounted in a frame when said pivot bar is mounted to a window sash, said pivot bar comprising a body member for being mounted in said sash, an extension extending peripherally outwardly from said body member along a plurality of sides of said body member to act as a lock for preventing said pivot bar from being inserted completely into said window sash, an arm extending outwardly from said extension in general alignment with said body member, said arm being of generally uniform cross section which is of smaller cross section than the cross section of said body member, said arm terminating in an edge at its end remote from said extension, said arm having first and second surfaces spaced from and parallel to each other, said first and second surfaces being interconnected by spaced and parallel opposite sides, said first and second surfaces and said opposite sides extending from said extension to said edges, a pair of pins mounted to said arm on said opposite sides of said arm and in alignment with each other, and said pins being disposed inwardly of each of said first and said second surfaces and inwardly of said edge.

14. The pivot bar of claim 13 including a channel in said first surface of said arm.

15. A balance shoe for use in a pivotable window sash assembly having a frame with a track therein in which said balance shoe would be slidably mounted and having a window sash with a pivot bar mounted to the window sash for pivotal engagement with said balance shoe to connect the window sash and the balance shoe for joint movement therewith, said balance shoe including a housing portion having a pair of sides and an interconnecting wall for being disposed toward the pivot bar, a circular opening in said wall, a locking member rotatably mounted in said circular opening, a keyway extending completely across said locking member at said circular opening, and a pair of slots mounted in diametric alignment with each other in said wall located at said circular opening for selective alignment with said keyway.

16. The balance shoe of claim 15 wherein said housing is of U-shape with an open side, said wall being disposed opposite said open side of said U-shape, said locking member being a disk mounted in said housing, a boss extending outwardly from said disk and disposed in said circular opening, and said keyway extending across said boss.

17. The balance shoe of claim 16 including an extension on said disk extending into said keyway.

18. The balance shoe of claim 17 including a plate member mounted in said open side of said U-shaped housing, said plate member being anchored at one end thereof remote from said disk and having a free end located at said disk, said free end being resiliently urged toward said disk, a tongue extending inwardly from said free end of said plate member, and said disk having a notch for selective engagement with said tongue.

19. The balance shoe of claim 18 wherein said tongue is engaged with said notch when said keyway and said slots are out of alignment with each other.

20. The balance shoe of claim 19 wherein said tongue has converging sides which are complementary to converging sides of said notch to function as cam structure.

* * * * *